United States Patent [19]

Zullo

[11] 4,342,321

[45] Aug. 3, 1982

[54] DEVICE FOR THE FORMATION OF GROUPS OF CIGARETTES

[75] Inventor: Antonio Zullo, Bologna, Italy

[73] Assignee: CIR S.p.A. Divisione Sasib, Bologna, Italy

[21] Appl. No.: 224,645

[22] Filed: Jan. 13, 1981

[30] Foreign Application Priority Data

Jan. 25, 1980 [IT] Italy ..... 12421 A/80

[51] Int. Cl.[3] ..... A24C 5/32; A24C 5/33; A24C 5/352

[52] U.S. Cl. ..... 131/282; 131/283; 53/148; 53/149; 53/150; 53/151; 198/458; 221/176; 221/123

[58] Field of Search ..... 131/282, 283; 53/148, 53/149, 150, 151; 198/458; 221/176, 123

[56] References Cited

U.S. PATENT DOCUMENTS

| | | | |
|---|---|---|---|
| 954,917 | 4/1910 | Bilgram . | |
| 1,295,722 | 2/1919 | Feldman | 53/151 |
| 1,755,045 | 4/1930 | Barkey | 221/123 |
| 1,851,922 | 7/1931 | Örström . | |
| 2,618,421 | 11/1952 | Basus . | |
| 2,682,983 | 7/1954 | Ashcroft . | |
| 2,809,768 | 10/1957 | Pollmann et al. . | |
| 3,024,585 | 3/1962 | Schubert et al. . | |
| 3,127,971 | 4/1964 | Schmermund . | |
| 3,241,289 | 3/1966 | Molins . | |
| 3,263,397 | 3/1963 | Cruickshank . | |
| 3,301,375 | 1/1967 | Schmermund . | |
| 3,435,940 | 4/1969 | Seragnoli . | |
| 3,445,986 | 5/1969 | Godet . | |
| 3,579,953 | 5/1971 | Gianese . | |
| 3,869,035 | 3/1975 | Focke . | |
| 4,096,682 | 6/1978 | Sheahan . | |
| 4,167,091 | 9/1979 | Ruppert et al. . | |
| 4,207,720 | 6/1980 | Tolasch et al. . | |

FOREIGN PATENT DOCUMENTS

| | | | |
|---|---|---|---|
| 520854 | 5/1940 | United Kingdom | 53/151 |
| 1249570 | 10/1971 | United Kingdom . | |
| 1481883 | 8/1977 | United Kingdom . | |
| 1483110 | 8/1977 | United Kingdom . | |

*Primary Examiner*—V. Millin

*Attorney, Agent, or Firm*—Spencer & Kaye

[57] ABSTRACT

A device for the formation of groups of cigarettes of at least one row of cigarettes arranged parallel side-by-side which comprises a feeding hopper subdivided by partition walls into a plurality of adjacent passageways which open into a collecting chamber delimited by a bottom plate and by side pushers. The partition wall located in the middle zone of the row of cigarettes, extends down to the bottom plate and engages by its terminal portion a groove provided in the said bottom plate. In this manner, the cigarette row being formed is divided into two row portions.

3 Claims, 2 Drawing Figures

DEVICE FOR THE FORMATION OF GROUPS OF CIGARETTES

BACKGROUND AND SUMMARY OF THE INVENTION

This invention has for its object to provide a device for forming a compact single-row layer of a given number of rodlike articles.

The invention relates, in particular, to machines for packing cigarettes or other similar rodlike articles, in which the cigarettes to be packed are composed in blocks, each of which consists of a certain number of single layers of cigarettes.

Typical, in this connection, is the block of 20 cigarettes, composed of three superimposed layers of cigarettes, respectively of seven, six and again seven cigarettes.

In a certain type of packing machines, predetermined single layers of cigarettes are composed in separate forming stations and are subsequently brought together and combined with each other, so as to obtain the desired block, ready for packing.

In the machines of the above type, for the composition of a single layer of n cigarettes, use is made of groups of n vertical or subvertical feeding channels or passage-ways, arranged close to each other, which lead to the row forming station, consisting substantially of a collecting chamber delimited by a bottom plate which stops the cigarettes at the outlet of the channels.

Presently, the partition walls which delimit the feeding channels are made so as to have their ends close to the cigarette stop plate, or are spaced away from the said plate, at a distance slightly greater than the cigarette diameter. When all of the feeding channels terminate close to the cigarette stop plate in the row-forming station, the greater width of the feeding channels in relation to the cigarette diameter, and the thickness of the partitions cause the formation of clearances between the cigarettes of the row being formed, at the moment in which said layer is ejected from the said forming station, for transfer into the receiving means.

Due to these clearances, which must be taken up, the transfer of the cigarettes into the receiving means involves the intermediary of a mouth type compactor, with decreasing section in the direction of movement of the cigarettes.

When instead the partition walls terminate spaced away from the bottom plate of the forming station, the clearances are taken up in the same forming station by means of side pushers of known type, which move laterally close to each other the cigarettes of the single layer or row being composed.

However, this side approach of the cigarettes of the row involves certain inconveniences, specially when the number of feeding channels is high and the total value of the clearances between the cigarettes corresponds to the diameter of a cigarette.

In fact, when these conditions occur, the cigarettes transferred by the feeding channels on the station stop plate, can occasionally get close to each other, against the outer wall of either one of the channels located at the extremities of the row, pushed by the overlying cigarettes which descend in the feeding channels. In this eventuality, the cigarette in either one of the extreme channels, which cigarette should be superposed on the one already deposited on the bottom plate, finds below a free space which allows it to descend to such an extent as to be pinched and, consequently, be damaged by the side pusher in its compacting motion. Obviously, the higher the number of cigarettes in a row, the greater is the above free space.

In the devices for composing numbered layers of cigarettes, in which the cigarettes descend along feeding channels which terminate at a certain distance from the row forming plate, the present invention is aimed at obviating the mentioned inconvenience of the pinching of some overlying cigarettes in the side feeding channels. For this purpose, the improvement comprises extending the partition wall which is in correspondence with the middle of the bundle of feeding channels leading to the forming chamber down to the composition plate so as to divide the cigarette row being formed into two parts possibly numerically equal or almost equal to each other. This arrangement divides between these two parts the total value of the side clearances between the cigarettes thereby avoiding the creation of an empty space which is sufficiently large for an overlying cigarette to fall down into the row and be pinched by one of the side pushers.

Preferably, the extreme lower edge of the middle partition wall fits into a groove of the bottom plate of the cigarette row forming chamber.

If the row being composed contains an even number of cigarettes, and, for instance, it is a row of six cigarettes, the partition wall will be right in the middle, and also exactly vertical. The partition wall in its terminal part, is made very thin in order not to considerably affect the clearance between the cigarettes of the row.

If, on the other hand, the row being composed contains an odd number of cigarettes, for instance, a row of 7 cigarettes, the partition wall will be only approximately intermediate and will divide the row into two parts, one containing four cigarettes and the other three. In this case, the extension portion by which the partition engages the bottom plate is preferably inclined in a direction away from the row portion in which the number of cigarettes is greater by one unit.

BRIEF DESCRIPTION OF THE DRAWINGS

The above and other features of the invention, and the resulting advantages, will be understood from the following detailed description of some preferred embodiments, given as a non restrictive example with reference to the attached drawing, in which.

DESCRIPTION OF THE PREFERRED EMBODIMENTS

Figure 1:
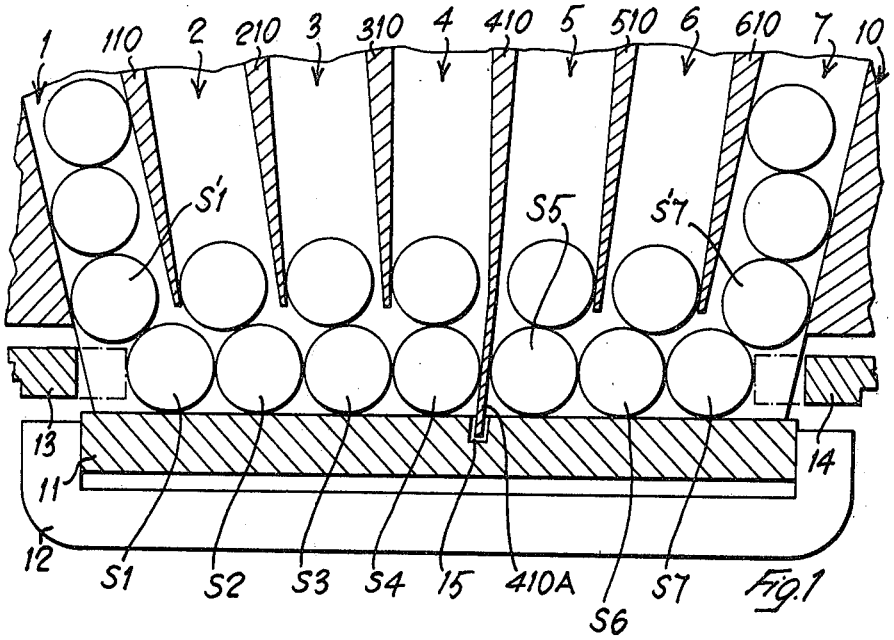
FIG. 1 is a vertical section view showing the improvement according to this invention, applied to a 7 channels forming chamber or station.

With reference to FIG. 1, a row or layer of seven cigarettes, close to each other, S1, S2, S3, S4, S5, S6, S7 is deposited by the respective subvertical passageways or feeding channels 1, 2, 3, 4, 5, 6, 7 of a feeding hopper 10 which opens into a collecting chamber closed at its bottom by a bottom plate 11 supported by a positioning frame 12. The cigarette row or layer is formed in the said collecting chamber, which is also termed a "forming station".

Channels 1 to 7 are separated from each other by partition walls 110, 210, 310, 410, 510, 610, whose thickness is progressively reduced towards the discharge ends and terminate, all but one (410), at a certain distance from the surface of bottom plate 11. This distance, as shown in the drawing, is slightly greater than the diameter of a cigarette.

A pair of side pushers 13, 14 cooperating in opposition between each other, move cigarettes S1–S7 of the layer close to each other and, with their opposed movement, eliminate the clearances existing between the cigarettes due to the greater width of the channels in relation to the diameter of the cigarettes, and to the terminal thickness of partition walls 110, 610.

As already broadly explained in the introductory part, in certain traditional devices for forming rows of cigarettes, all the partitions walls terminate at a distance from the surface of stop plate 11, whereby the clearance taken up by pushers 13, 14 is equal to or slightly lower than the diameter of a cigarette. Under these conditions, either one of the overlying cigarettes of the extreme passageways, that is one of the cigarettes indicated by S'1 and S'7 in FIG. 1, can be pinched and consequently damaged by the adjacent pusher (13 or 14).

According to the invention, the above inconvenience is eliminated by downwardly extending the partition 410 so that it terminates with a thin terminal portion 410A which preferably engages a corresponding groove 15 in the bottom plate 11.

In the apparatus shown in FIG. 1, the composed layer or row of cigarettes includes an odd number of cigarettes, that is precisely seven cigarettes. In this case, the extension 410A is slightly inclined in the direction away from the row portion including four cigarettes (the left hand portion in FIG. 1), in which the amount of the clearances is greater.

Figure 2:
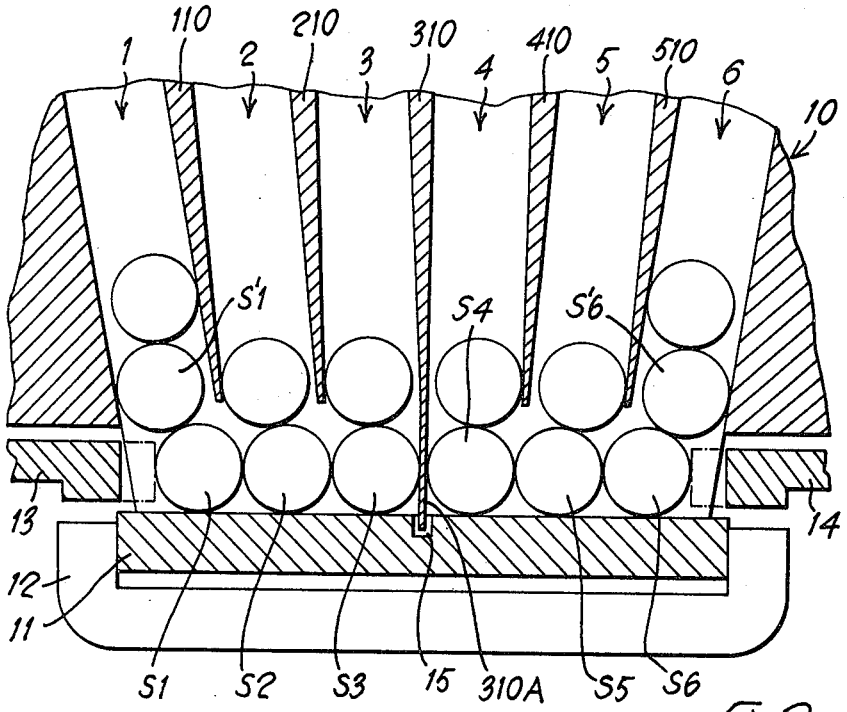
FIG. 2 is a view similar to FIG. 1 which shows the improvement according to the invention applied to a 6 channels forming chamber or station.

In the embodiment of FIG. 2 a layer or row of an even number of cigarettes is formed with precisely six cigarettes. In this case, the middle partition wall 310 extends with its terminal portion 310A till it engages the groove 15 of bottom plate 11, in a perfect vertical position.

In both cases, the thickness of the terminal portions 410A and 310A is very thin, so as to eliminate the need of the intermediate converging mouth for the transfer of the row of cigarettes into the receiving means. It is understood, that the invention is not restricted to the embodiments which have been described as an example, but can be broadly changed or modified, particularly in its constructive details, without departing from the principle of the invention as described above and claimed hereafter:

What is claimed is:

1. A device for the formation of a single row of cigarettes having a predetermined number of cigarettes therein, the cigarettes in said row being side-by-side and having their longitudinal axes parallel to each other, comprising a feeding hopper subdivided by partition walls into a plurality of adjacent passageways, the number of said passageways being equal to said predetermined number of cigarettes in said row; and a collecting chamber, said collecting chamber including a bottom plate positioned below said plurality of passageways and side pushers located above and at each end of said bottom plate, one of said partition walls being centrally located within said hopper and having an end secured to said bottom plate to prevent movement of said partition in a direction transverse to the longitudinal axes of said cigarettes, and the remaining partition walls each having an end extending to a distance from said bottom plate which is slightly greater than the diameter of said cigarette, whereby each of said passageways feeds a single file of superposed cigarettes into said collecting chamber.

2. A device according to claim 1 wherein the end of said one partition wall engages a groove in the surface of said bottom plate.

3. A device according to claim 1 or 2 wherein said predetermined number of cigarettes and passageways is odd, said one partition wall divides said row of cigarettes into a shorter row portion and a longer row portion and said one partition wall is slightly inclined in a direction away from the longer row portion of said cigarettes.

* * * * *